United States Patent [19]

Stamper

[11] Patent Number: 4,470,558

[45] Date of Patent: Sep. 11, 1984

[54] RETRACTABLE CLOTHESLINE DEVICE

[75] Inventor: James F. Stamper, Nashville, Ind.

[73] Assignee: Lear Siegler, Inc., Santa Monica, Calif.

[21] Appl. No.: 388,840

[22] Filed: Jun. 16, 1982

[51] Int. Cl.[3] ..... B65H 75/48

[52] U.S. Cl. ..... 242/107.15; 242/107.6; 242/100.1

[58] Field of Search ..... 242/107.1–107.15, 242/107.6, 99, 100, 100.1, 107.3, 84.8, 86.1, 86.7

[56] References Cited

U.S. PATENT DOCUMENTS

| | | | |
|---|---|---|---|
| 346,995 | 8/1886 | Griswold | 242/107.15 |
| 2,080,815 | 5/1937 | Gasstrom | 242/107.6 |
| 2,637,109 | 5/1953 | Willis | 242/107.11 X |
| 2,776,644 | 1/1957 | Fontaine | 242/99 |
| 2,926,865 | 3/1960 | Humphreys | 242/107.13 |
| 2,989,267 | 6/1961 | Mehl | 242/107.13 X |
| 3,127,126 | 3/1964 | Hancock | 242/99 |
| 3,197,155 | 7/1965 | Chow | 242/107.1 |
| 4,165,053 | 8/1979 | Konig | 242/107.1 |

*Primary Examiner*—John M. Jillions

*Attorney, Agent, or Firm*—Reising, Ethington, Barnard, Perry & Milton

[57] ABSTRACT

A retractable clothesline device for storing the clothesline when in a fully retracted position and enabling the clothesline to be readily extended from its retracted position for use, said device comprising an outer housing having a plurality of openings therethrough and a spool disposed within the housing having at least two outwardly extending axially spaced radial flanges. The spool includes an inner surface with outer edges defining a central axial opening. A hub with an opening therethrough is secured to the inner surface of the spool between the outer edges. At least one clothesline extending through at least one opening in the housing is provided with the clothesline having at least one end secured to the spool between the two flanges such that the clothesline is stored on the spool when in a retracted position. A handle, slidably disposed on the clothesline, is provided for extending the clothesline from a retracted position. A spool bearing is also provided and disposed between the spool and housing. A spindle extends through openings in the hub, bearing and housing and biasing means are provided between the spool and spindle with the biasing means being in a biased condition when the clothesline is in an extended position and in a substantially unbiased condition relative to the biased condition when the clothesline is in a fully retracted position. Means for securing the spool in a fixed non-rotatable position relative to the spindle are further provided to secure the clothesline when extended to a desired position.

16 Claims, 12 Drawing Figures

RETRACTABLE CLOTHESLINE DEVICE

TECHNICAL FIELD

The subject matter of the present invention relates to a retractable clothesline device for storing the clothesline when in a fully retracted position and enabling the clothesline to be readily extended from its retracted position and secured in the position at which it is desired to be used.

BACKGROUND ART

Prior art clothesline devices provide a retractable clothesline or a plurality of retractable clotheslines which may be extended to a desired position and locked in place for use. These devices are distinguishable by the means utilized for storing the clothesline when in a retracted position, the method utilized for locking the clothesline in a desired extended position, and the biasing means used for extending and retracting the clothesline.

The majority of these prior art devices utilize some form of a spool or reel to store the clothesline when in a retracted position. In one prior art device, five clotheslines are provided which are all stored upon a single large reel when the clothelines are in their retracted positions. The main problem with this device is that the winding of five clotheslines around a single reel does not assure uniform storage and the clotheslines often become twisted together making it difficult to extend and retract them. In order to alleviate the problem of uniform winding other devices have provided spools with more than one storage area or have used more than one spool to receive different portions of a single clothesline. For example, in one prior art device, a single clothesline provides two lines for hanging clothes and when retracted into its dispenser is stored on two separate spools. The problem with the use of two separate spools is that differences between the biasing rates of the two spools can make it difficult to find a desired position, and further requires that each spool be independently locked.

The majority of the prior art devices utilize locking mechanisms in conjunction with the spool or reel. The most common method of locking the clothesline to prevent it from movement once in a desired position is to place a locking member between stops on the spool or reel which interfere with the movement of the spool or reel. The use of an inteference locking mechanism has it drawbacks in that the positions in which the clothesline can be set are limited to the positions defined by the space between the stops on the spool. An additional problem with the interference type of lock is that the spool often remains free floating on its shaft after locking as it is only restricted from radial movement and can still move axially within the confines of the enclosure in which it is contained.

Another method of locking the clothesline utilizes a lock placed on the clothesline when it is extended to a desired position. The lock prevents the clothesline from going back into the enclosure in which the clothesline is stored. The drawback to this method is that the contact with the clothesline tends to wear away the clothesline if the clothesline is used in the same position for an extended period of time.

The last distinguishing feature between the prior art devices is the means in which the spool or reel is biased so that the clothesline will extend and retract when desired. Common biasing means include the use of a wound wire or flat metal spring between a shaft and the spool. When wound wire springs are used around a shaft at the core of the spool, they are difficult to replace when broken and usually force the disposal of the entire unit. Accordingly, the use of wound flat metal springs is preferred, but they have the disadvantage of often becoming bound up preventing the clothesline from being extended and retracted in a smooth, uniform manner.

An additional drawback to prior art devices are their inability to provide a means for readily attaching the extended end of the clothesline to a generally horizontally extending member. While the housings of some of the prior art devices are adapted for mounting, they generally do not include any means for readily securing the extended end of the clothesline.

DISCLOSURE OF THE INVENTION

An object of the present invention is to provide a retractable clothesline device having two locking mechanisms to prevent the clothesline from movement once set in a desired position.

Another object of the present invention is to provide a retractable clothesline device in which the spool is not free floating when the clothesline is locked into a desired position.

An additional object of the present invention is to provide a retractable clothesline device having separate storage areas for each line when the clothesline is in a retracted position.

Another object of the present invention is to provide a retractable clothesline device in which the extending of the clothesline provides lines of equal length irrespective of whether the clothesline is stored in equal portions within the separate storage areas.

An additional object of the present invention is to provide a retractable clothesline device which provides for the uniform biasing and unbiasing of the biasing means allowing the clothesline to be extended and retracted in a smooth, uniform manner.

A further object of the present invention is to provide a retractable clothesline device having a handle which is readily securable to a generally horizontally extending member.

In carrying out the foregoing and other objects, a retractable clothesline device according to the present invention is provided for storing the clothesline when in a fully retracted position and enabling the clothesline to be readily extended from its retracted position for use. The device includes an outer housing having a plurality of openings therethrough and a spool disposed within the housing having at least two outwardly extending axially spaced radial flanges. In the preferred embodiment disclosed the device includes two outer and one central axially spaced radial flanges. The spool includes an inner surface with outer edges which define a central axial opening through the spool. The spool also includes a hub with an opening therethrough secured to the inner surface of the spool and disposed between the outer edges of the central axial opening.

At least one clothesline is provided extending through at least one opening in the housing and having at least one end secured to the spool between two flanges such that the clothesline is stored on the spool when in a retracted position. In the preferred embodiment disclosed, one clothesline is provided which extends through two openings in the housing and has each end secured to the central flange of the spool such that when the clothesline is extended, two lines are provided for hanging clothes. When the clothesline is retracted, it is stored in separate portions on opposite sides of the central flange on the spool.

A handle, slidably disposed on the clothesline, is provided for extending the clothesline from a retracted position. The handle is adapted to be readily secured to a generally horizontally extending member.

A spool bearing having an opening therethrough is provided and is disposed between the spool and housing. Extending through openings in the hub, bearing and housing, is a spindle having inner and outer ends. The spindle includes an end portion secured to its inner end which preferably has a frustoconical shape with the top of the frustum being secured to the inner end of the spindle. Biasing means between the spool and spindle are provided with the biasing means being in a biased condition when the clothesline is in an extended position and in a substantially unbiased condition relative to the biased condition when the clothesline is in a fully retracted position. In the preferred embodiment disclosed, the biasing means comprises a spirally wound flat metal spring having an outer end anchored to the spool and an inner end secured to the spindle. The spring is in contact with a side of the hub and a side of the spool bearing. These sides in contact with the spring preferably have frustoconical surfaces which provide for the uniform biasing and unbiasing of the spring as the clothesline is extended and retracted.

The spool further includes a plurality of tapered circumferentially spaced axially extending ribs secured to the side of the hub not in contact with the spring, and the inner surface of the spool. These ribs include surfaces tapering inwardly from the outer edge of the spool towards the opening in the hub. The surfaces of the ribs define a frustoconical shape with the opening in the hub defining the top of the frustum. The spool further includes a plurality of circumferentially spaced stops on the side of the flange nearest the housing. In the preferred embodiment disclosed, the stops comprise axially extending stop members having bearing surfaces.

A clamping member is provided which is pivotally attached to the outer end of the spindle. When the clamping member is in a clamped position it exerts an axial force on the outer end of the spindle pulling the end portion into frictional engagement with the surfaces of the ribs thereby securing the spool in a fixed non-rotatable position relative to the spindle. The clamping member also includes a pin which extends through an opening in the housing and is disposed between two stops when the clamping member is in a clamped position. The pin provides a secondary lock on the spool by preventing the spool from rotating any distance greater than the distance between the pin and the furthest of the stops between which it is disposed.

Other objects, advantages and features of the invention will become apparent from the following description when taken in connection with the accompanying drawings.

BEST MODE FOR CARRYING OUT THE INVENTION

Figure 1:
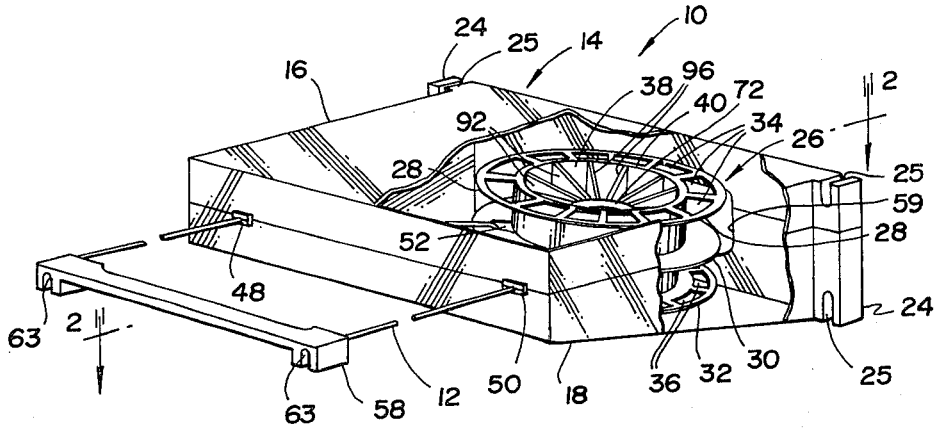
FIG. 1 is a cutaway perspective view of a retractable clothesline device in accordance with the present invention.
Figure 2:
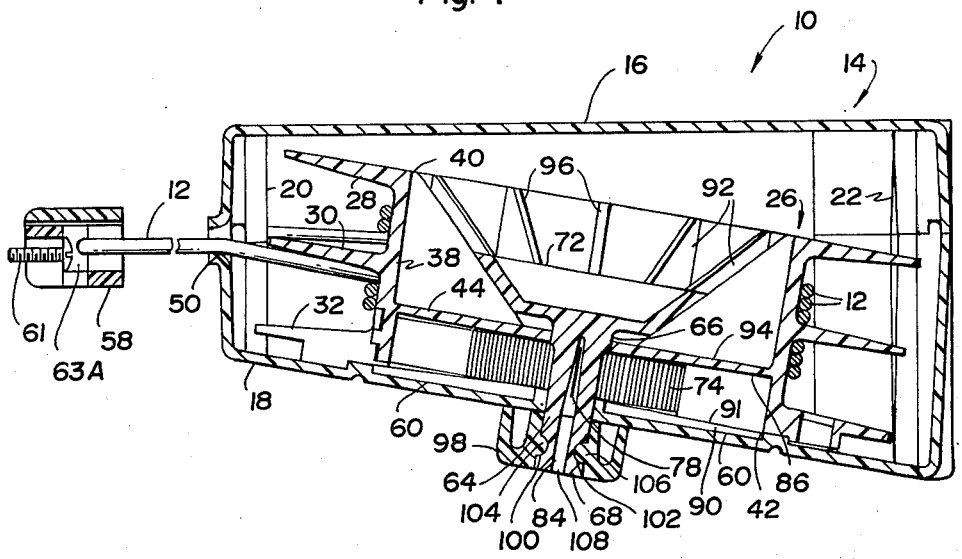
FIG. 2 is a cross sectional view of the retractable clothesline device taken along lines 2—2 of FIG. 1.

With reference to FIG. 1, reference numeral 10 generally designates a retractable clothesline device for storing a clothesline 12 when in a fully retracted position and enabling the clothesline to be readily extended from its retracted position for use. The device includes an outer housing, generally 14, having an upper portion 16 and a lower portion 18. The upper portion 16 and lower portion 18 are secured together by suitable connectors 20 and 22 as indicated in FIG. 2. The housing 14 has a plurality of openings therethrough and includes a mounting bracket 24 for mounting the device on a rigid surface. The mounting bracket 24 preferably has tapered notches 25 so that the device 10 may be more easily mounted.

Figure 3:
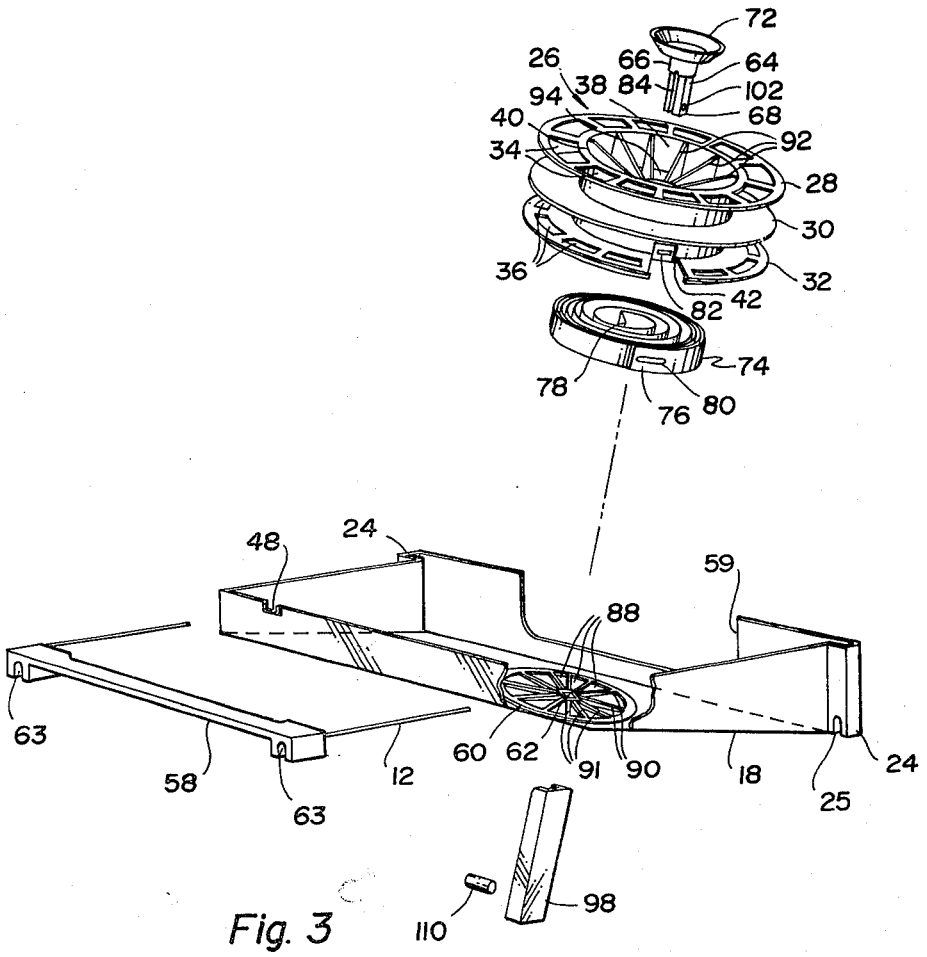
FIG. 3 is a perspective view of the lower half of the housing showing the assembly of the components within the housing.
Figure 8:
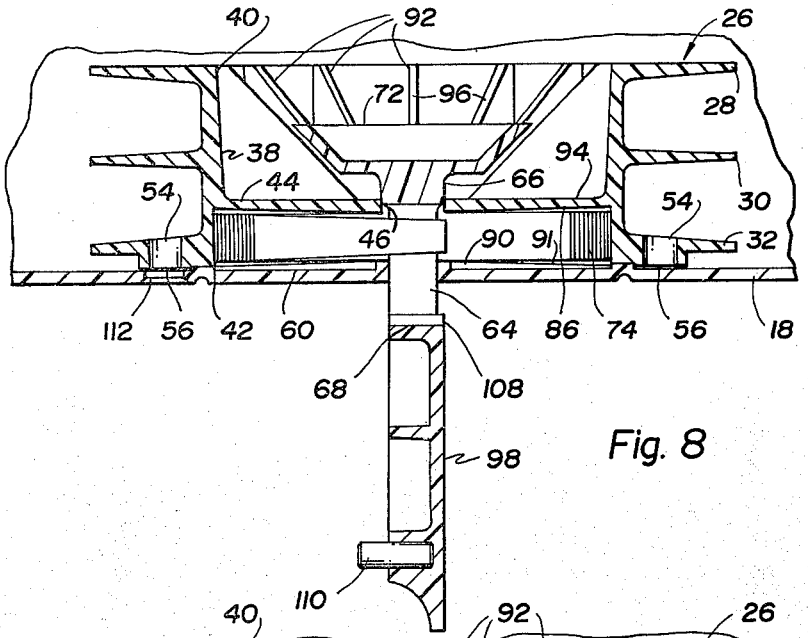
FIG. 8 is a partial cross sectional view of the device showing the clamping member in an unclamped position.
Figure 9:
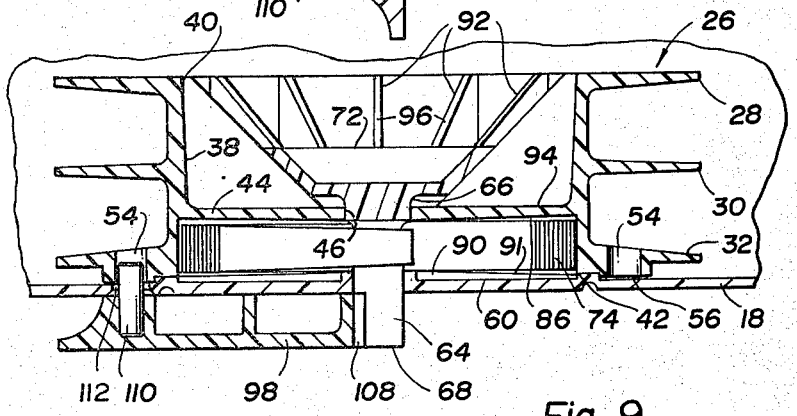
FIG. 9 is a partial cross sectional view of the device showing the clamping member in a clamped position.

A spool 26 is disposed within the housing 14 as shown in FIGS. 1, 2 and 3. The spool 26 preferably has three outwardly extending axially spaced radial flanges; an upper radial flange 28, an intermediate radial flange 30 and a lower radial flange 32. In the preferred embodiment the upper flange 28 and lower flange 32 have a plurality of circumferentially spaced openings 34 and 36 respectively which provide a savings of material when the spools are manufactured. Openings can also be provided in the central flange 30 if desired, but they may interfere with the storage of the clothesline 12. The spool 26 also includes an inner surface 38 having circular outer edges 40 and 42 which define a central axial opening as shown in FIGS. 2, 4, 8 and 9. The spool 26 further includes a hub 44 with an opening 46 therethrough secured to the inner surface 38 and disposed between outer edges 40 and 42. The lower radial flange 32 of the spool 26 includes a plurality of circumferentially spaced axially extending stop members 54 which have bearing surfaces 56 as shown in FIGS. 8 and 9. The bearing surfaces 56 are in contact with the lower portion 18 of the housing 14, and allow the spool 26 to rotate more smoothly as the clothesline 12 is extended and retracted.

The clothesline 12 extends through openings 48 and 50 as shown in FIGS. 1 and 2. The openings 48 and 50 are preferably beveled to allow the clothesline to be more smoothly extended and retracted. The clothesline 12 is secured to the spool 26 in the preferred embodiment by knotting the ends together within a notch 52 in the central flange 30. Alternatively, the ends of the clothesline 12 can be secured to the spool 26 by feeding the ends through holes (not shown) in the spool 26 and knotting each end against the inner surface 38 on opposite sides of the central flange 30.

Figure 5:
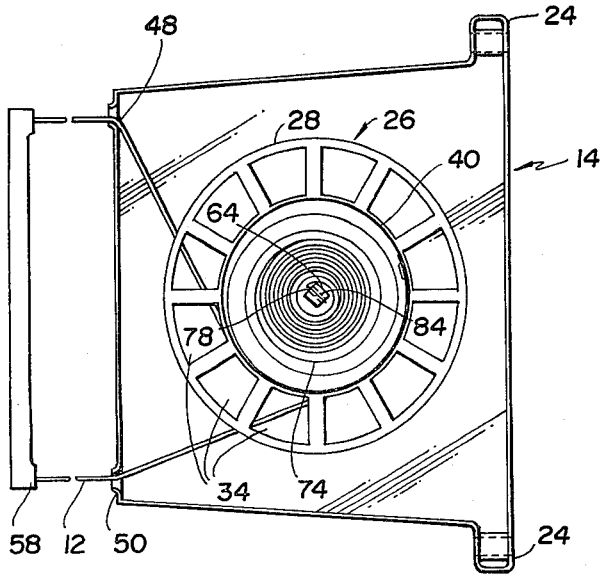
FIG. 5 is a top elevational view of the device with the top of the housing, the hub and axial ribs removed showing the clothesline in an extended position.
Figure 6:
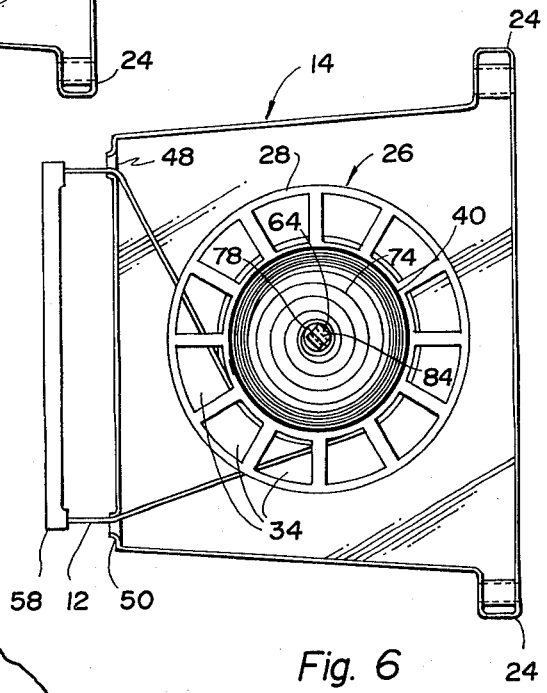
FIG. 6 is a top elevational view of the device with the top of the housing, hub and axial ribs removed showing the clothesline in a retracted position.

When the clothesline 12 is in an extended position, as shown in FIG. 5, two lines are provided for hanging clothes. When the clothesline 12 is in its retracted position, as shown in FIG. 6, it is stored in two portions with one portion being stored between the upper 28 and central 30 radial flanges and the other portion being stored between the central 30 and lower 32 radial flanges.

Figure 10:
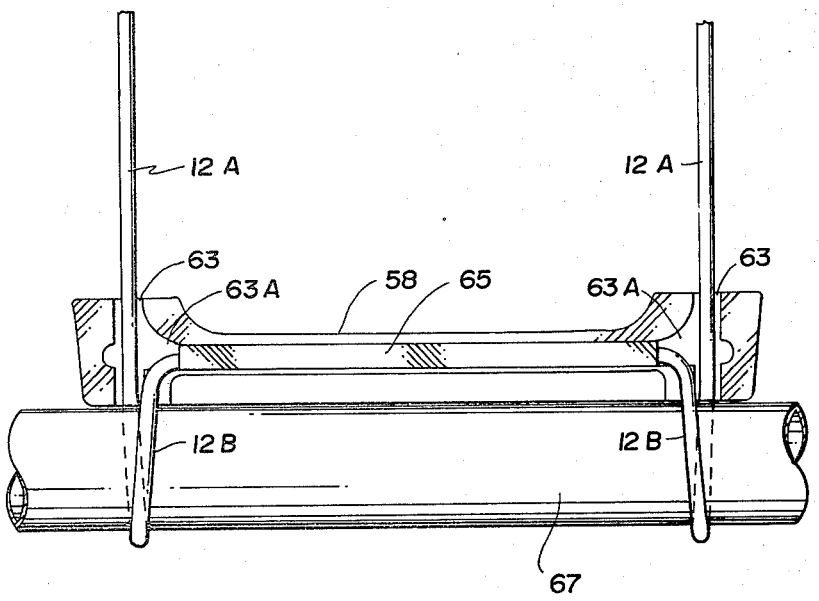
FIG. 10 is a bottom elevational view of the handle and clothesline secured to a generally horizontally extending member.

A handle 58 is also provided and is slidably disposed on the clothesline 12. With reference to FIG. 10, the handle includes open end channels 63 which extend through the handle in a direction transverse to its longitudinal axis. A central channel 63A is provided which connects the end channels 63. The central channel 63A is partially covered with cover 65 to prevent the handle 58 from separating from the clothesline 12. The clothesline 12 extends through the channels 63 and 63A.

The handle 58 is adapted to be secured to a generally horizontally extending member 67 such as a T-bar which is commonly used to suspend clotheslines. The handle 58 is secured to the T-bar 67 by passing it over and around the T-bar and bringing it up between the two lines 12A as shown in FIG. 10. The handle 58 is then positioned against the T-bar 67 and the lines 12A are pulled taught thereby pulling lines 12B against the T-bar 67 and disposing the lines 12B against the cover 65 within the central channel 63A. The handle 58 is then placed such that lines 12A are disposed within the end channels 63 thereby securing the handle 58 to the T-bar 67. The handle 58 may alternatively be secured to the T-bar 67 by first passing it under and around the T-bar 67 in a like procedure. The handle 58 is also adapted to be mounted on a rigid surface, such as with screw 61 as shown in FIG. 2.

The storage of the clothesline 12 in separate portions when combined with the slidable handle 58 will always allow the user to obtain two lines for hanging clothes which are of equal length. It is not necessary that the clothesline 12 be stored in equal portions or that each line be extended and retracted at equal rates. If due to differences in winding or for some other reason the handle 58 when extended provides lines of unequal length, the handle 58 may be slid along the clothesline 12 until two lines of equal length are obtained between the handle 58 and the housing 14. Alternatively, if the handle 58 is mounted, the clothesline 12 can be slid through the handle 58 to achieve lines of equal length.

An opening 59 is provided in the back of the housing 14, as shown in FIGS. 1 and 3, for removing and replacing the clothesline 12. The clothesline 12 may be readily removed and replaced, if necessary, by fully extending the clothesline 12 and rotating the spool 26 so that the notch 52 on the central flange 30 is disposed near the opening 59. The clothesline 12 may then be unknotted and replaced with a new clothesline.

Figure 4:
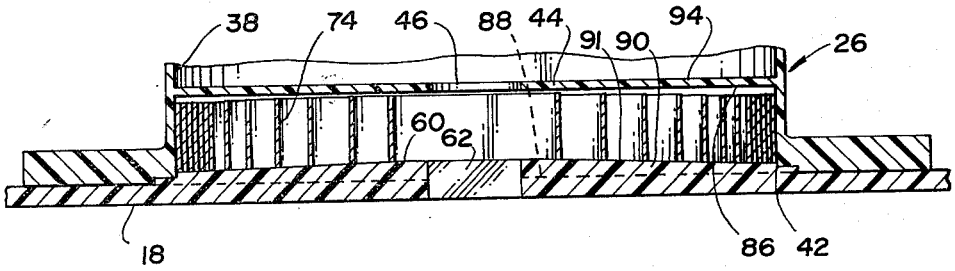
FIG. 4 is a partial cross sectional view of the lower portion of the spool, spool bearing, and housing.

The device further includes a spool bearing 60 which has an opening 62 therethrough as shown in FIG. 4. The spool bearing 60 is disposed between the spool 26 and the lower portion of the housing 18. In the preferred embodiment, the spool bearing 60 is molded to the lower portion 18 of the housing 14. A spindle 64 is further provided having an inner end 66 and an outer end 68. The spindle 64 extends through opening 46 in the hub and opening 62 in the spool bearing. As the spool bearing 60 is preferably molded into the lower portion 18 of the housing 14, the opening 62 in the spool bearing also extends through the lower portion 18 of the housing 14. Therefore, the spindle 64 extends through the hub 44, the spool bearing 60 and the lower portion of the housing 18. The opening 62 in the spool bearing 60 and lower portion 18 of the housing 14 preferably defines a square. The portion of the spindle 60 which extends through opening 62 preferably has a square cross section thereby preventing the spindle 60 from rotating when inserted through the opening 62. The spindle 64 further includes an end portion 72 fixedly secured to the inner end 66 of the spindle 64. The end portion 72 has a frustoconical shape with the top of the frustum being secured to the inner end 66 of the spindle 64.

A spirally wound flat metal spring 74 is provided as the biasing means and is disposed within the central axial opening of the spool 26. The spring 74 has an outer end 76 anchored to the spool 26 and an inner end 78 secured to the spindle 64. The outer end 76 is anchored to the spool by fitting a slot 80, located in the outer end of the spring 74, over a notch 82 on the spool 26. Inner end 78 fits into a central slot 84 in the spindle 64 as shown in FIG. 3. The central slot 84 of the spindle 64 extends from near the inner end 66 of the spindle 64 through the outer end 68 of the spindle 64. The length of the central slot 84 allows the spindle 64 to be more easily inserted through the opening 46 in the hub 44, around the inner end 78 of the spring 74, and through the opening 62 in the spool bearing 60 and lower portion 18 of the housing 14. This makes the securing of the inner end 78 of the spring 74 much easier during assembly of the device 10.

The spring 74 is further disposed between and in contact with a side 86 of the hub 44 and a side 88 of the spool bearing 60 as shown in FIGS. 8 and 9. The spring 74 is in a biased condition when the clothesline 12 is in an extended position, as shown in FIG. 5, and in a substantially unbiased condition relative to the biased condition when the clothesline 12 is in a fully retracted position as shown in FIG. 6. The side 88 of the spool bearing 60 in contact with the spring 74 has a plurality of circumferentially spaced axially extending bearing members 90 as shown in FIG. 3. The surfaces 91 of the bearing members 90 define a frustoconical shape to provide for the uniform biasing and unbiasing of the spring 74 as the clothesline 12 is extended and retracted. While in the preferred embodiment, the frustoconical shape is defined by the circumferentially spaced bearing members 90, it is also possible to use a spool bearing 60 in which the side 88 defines a solid frustoconical shape. The side 86 of the hub 44 in contact with the spring 74 also has a surface defining a frustoconical shape to further provide for the uniform biasing and unbiasing of the spring 74. These frustoconical shapes in contact with the spring 74 prevent the spring 74 from binding as the clothesline 12 is extended and retracted, a problem which is common in prior art devices utilizing wound flat metal springs.

A plurality of tapered circumferentially spaced axially extending ribs 92 are further provided and are secured to the side 94 of the hub 44 not in contact with the spring 74, and the inner surface 38 of the spool 26, as shown in FIGS. 8 and 9. The ribs 92 have surfaces 96 tapering inwardly from the outer edge 40 of the spool 26 toward the opening 46 in the hub 44. The surfaces 96 define a frustoconical shape with the opening 46 in the hub 44 defining the top of the frustum. Openings (not shown) may be provided in the hub 44 between the axial ribs 92 to provide a savings of material if desired.

A clamping member 98 is pivotably attached to the outer end 68 of the spindle 64 and when in a clamped position exerts an axial force on the outer end 68 of the spindle 64 pulling the end portion 72 into frictional engagement with the surfaces 96 of the ribs 92 thereby securing the spool 26 in a fixed non-rotatable position relative to the spindle 64, as shown in FIG. 9. The frustoconical shape of the end portion 72 is oriented and sized such that it mates and fits securely within the frustoconical shape defined by the surfaces 96 of the axial ribs 92 when the clamping member 98 is in its clamped position. While in the preferred embodiment the frustoconical shape with which the end portion 72 mates is defined by axial ribs 92, it is also possible to utilize a solid frustoconical shape on side 94 of the hub 44. The use of the surfaces 96 of the ribs 92 however, reduces the surface area of frictional contact between the spool 26 and end portion 72, providing a greater unit pressure for securing the spool 26. The use of the ribs 92 has the further advantage of providing a savings in materials over the use of a solid frustoconical shape. When the clamping member 98 is in an open position, as shown in FIG. 8, the end portion 72 is out of contact with the surface 96 of the ribs 92 thereby allowing the spool to freely rotate within the housing 14.

Figure 7A:
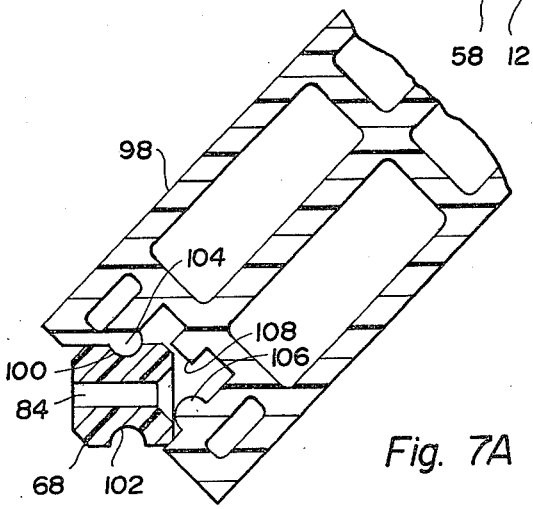
FIGS. 7A, 7B and 7C are partial cross sectional views showing the attaching of the clamping member to the outer end of the spindle.
Figure 7B:
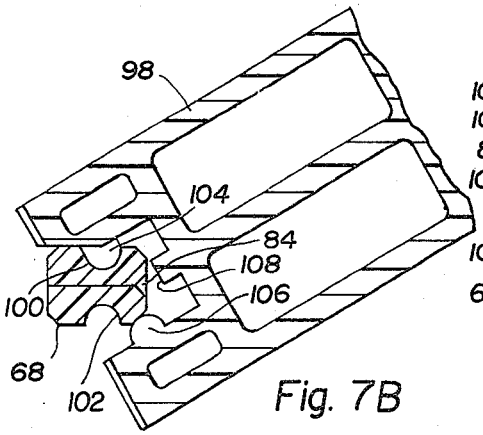
Figure 7C:
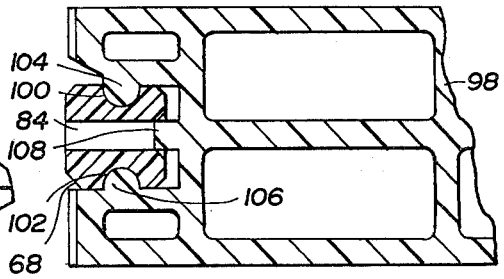

The attachment of the clamping member 98 to the outer end 68 of the spindle 64 is shown in FIGS. 7A, 7B and 7C. The outer end 68 of the spindle 64 includes spherical notches 100 and 102 with the clamping member 98 having corresponding spherical nubs 104 and 06. The clamping member further includes a notch 108 which fits into the central slot 84 of the spindle 64 when the clamping member is attached to the outer end 68 of the spindle 64. The clamping member 98 is attached to the outer end 68 of the spindle 64 by placing the clamping member in its assembly position such that nub 104 fits into notch 100 as shown in FIG. 7A. The clamping member 98 is rotated thereby compressing the outer end 68 of the spindle 64 as shown in FIG. 7B. The clamping member 98 is further rotated such that nub 106 is fit into notch 102 thereby releasing the compression of the outer end 68 of the spindle 64 and disposing notch 108 into the central slot 84 of the spindle 64. The central slot 84 is outwardly tapered to assist in the insertion of the notch 108. Notch 108 creates an outward pressure preventing the outer end 68 of the spindle 64 from compressing thereby forcing notches 100 and 102 securely into nubs 104 and 106 respectively, as shown in FIG. 7C. The pressure between the nubs 104 and 106 and notches 100 and 102 secure the clamping member 98 to the outer end 68 of the spindle 64 as the clamping member 98 is pivoted between its clamped and unclamped positions.

As can be seen in FIGS. 3, 8 and 9, a pin 110 is further provided which is fixedly secured to the clamping member 98. The pin 110 extends through an opening 112 in the lower portion 18 of the housing 14 and is disposed between two stop members 54 when the clamping member 98 is in its clamped position as shown in FIG. 9. The disposing of pin 110 between two stop members 54 acts as a secondary locking mechanism. If the frictional engagement of the end portion 72 with the surfaces 96 of the ribs 92 (e.g. the primary locking mechanism) for some reason fails to secure the spool in a fixed non-rotatable position relative to the spindle 64, or if the clamping member 98 is slightly moved from its clamped position, the disposing of the pin 110 between two stop members 54 will prevent the spool 26 from rotating any distance greater than the distance between the pin 110 and the furthest of the stop members 54 between which it is disposed.

While in the preferred embodiment, the housing has a single spool with one clothesline which provides two lines for hanging clothes, it would be obvious to a person having ordinary skill in the art, that a larger housing can be provided using two or more spools in which four or more lines are provided for hanging clothes.

While a specific form of the invention is described in the foregoing specification and illustrated in the accompanying drawings, it should be understood that the invention is not limited to the exact construction shown. Alternations in the construction and arrangement of parts, all falling within the scope and spirit of the invention, will be apparent to those skilled in the art from the following claims.

What is claimed is:

1. A retractable clothesline device for storing the clothesline when in a fully retracted position and enabling the clothesline to be readily extended from its retracted position for use, said device comprising: an outer housing having a plurality of openings therethrough; a spool disposed within the housing having at least two outwardly extending axially spaced radial flanges; said spool having an inner surface with outer edges defining a central axial opening; said spool further including a hub with an opening therethrough secured to the inner surface and disposed between the outer edges; at least one clothesline extending through at least one opening in the housing and having at least one end secured to the spool between the two flanges such that the clothesline is stored on the spool when in a retracted position; a spool bearing having an opening therethrough disposed between the spool and housing; a spindle having inner and outer ends extending through the openings in the hub, bearing and housing; biasing means between the spool and spindle; said biasing means being in a biased condition when the clothesline is in an extended position and in a substantially unbiased condition relative to the biased condition when the clothesline is in a fully retracted position; and means for securing the spool in a fixed non-rotatable position relative to the spindle, the biasing means including a spirally wound flat metal spring disposed within the central axial opening of the spool having an outer end anchored to the spool and an inner end secured to the spindle, the spring being disposed between and in contact with a side of the hub and a side of the spool bearing, the spindle including an end portion fixedly secured to the inner end of the spindle, the side of the spool bearing in contact with the spring having a frustoconical shape to provide for the uniform biasing and unbiasing of the spring as the clothesline is extended and retracted, said assembly including a plurality of tapered circumferentially spaced axially extending ribs secured to the side of the hub not in contact with the spring, and the inner surface of the spool, the ribs including surfaces tapering inwardly from the outer edge of the spool towards the opening in the hub; said surfaces defining a frustoconical shape with the opening in the hub defining the top of the frustum, the means for securing the spool including a clamping member pivotally attached to the outer end of the spindle which when in a clamped position exerts an axial force on the outer end of the spindle pulling the end portion into frictional engagement with the surfaces of the ribs thereby securing the spool in a fixed non-rotatable position relative to the spindle.

2. A device as in claim 1 wherein the side of the spool bearing in contact with the spring further includes a plurality of circumferentially spaced axially extending bearing members having surfaces defining said frustoconical shape.

3. A device as in claim 1 wherein the spool bearing is fixedly secured to the housing.

4. A device as in claim 1 wherein the side of the hub in contact with the spring also has a surface defining a frustoconical shape to further provide for the uniform biasing and unbiasing of the spring as the clothesline is extended and retracted.

5. A device as in claim 1 wherein the end portion has a frustoconical shape with the top of the frustum secured to the inner end of the spindle.

6. A device as in claim 1 wherein a side of the flange nearest the housing includes a plurality of circumferentially spaced stops.

7. A device as in claim 6 wherein the stops comprise axially extending stop members.

8. A device as in claim 7 wherein the axially extending members include bearing surfaces.

9. A device as in claim 6 wherein the clamping member includes a pin which extends through an opening in the housing and is disposed between two stops when the clamping member is in a clamped position thereby preventing the spool from rotating a distance greater than the distance between the pin and the furthest of the stops between which it is disposed.

10. A device as in claim 1 wherein the spindle extends through a square opening in the housing.

11. A device as in claim 10 wherein the portion of the spindle which extends through the opening in the housing has a square cross section thereby preventing the spindle from rotating.

12. A device as in claim 1 wherein the housing includes a mounting bracket.

13. A device as in claim 1 further including a handle slidably disposed on the clothesline for extending the clothesline from a retracted position.

14. A device as in claim 13 further including securing means for readily securing the handle to a generally horizontally extending member.

15. A device as in claim 1 further including means for readily detaching the clothesline from the spool.

16. A retractable clothesline device for storing the clothesline when in a fully retracted position and enabling the clothesline to be readily extended from its retracted position for use, said device comprising: an outer housing having a plurality of openings therethrough and including a mounting bracket; a spool disposed within the housing having two outer and one central, outwardly extending axially spaced radial flanges; said spool having an inner surface with outer edges defining a central axial opening; said spool further including a hub with an opening therethrough secured to the inner surface and disposed between the outer edges; at least one clothesline extending through two openings in the housing and having each end detachably secured to the spool such that the clothesline is stored on the spool in separate portions on opposite sides of the central flange when in a retracted positon; a side of the outer flange nearest the housing including a plurality of circumferentially spaced axially extending stop members having bearing surfaces; a handle slidably disposed on the clothesline for extending the clothesline from a retracted position; said handle being readily securable to a generally horizontally extending member; a spool bearing having an opening therethrough fixedly secured to the housing, and being disposed between the spool and housing; a spindle having inner and outer ends extending through the openings in the hub, bearing and housing; the openings in the spool bearing and housing through which the spindle extends defining a square; the portion of the spindle which extends through the openings in the spool bearing and housing having a square cross section thereby preventing the spindle from rotating; said spindle further including an end portion having a frustoconical shape with the top of the frustum secured to the inner end of the spindle; a spirally wound flat metal spring disposed within the central axial opening of the spool having an outer end anchored to the spool and an inner end secured to the spindle; said spring being disposed between and in contact with a side of the hub and a side of the spool bearing; said spring being in a biased condition when the clothesline is in an extended position and in a substantially unbiased condition relative to the biased condition when the clothesline is in a fully retracted position; said side of the spool bearing in contact with the spring having a plurality of circumferentially spaced axially extending bearing members having surfaces defining a frustoconical shape to provide for the uniform biasing and unbiasing of the spring as the clothesline is extended and retracted; said side of the hub in contact with the spring also having a surface defining a frustoconical shape to further provide for the uniform biasing and unbiasing of the spring; a plurality of tapered circumferentially spaced axially extending ribs secured to the side of the hub not in contact with the spring, and the inner surface of the spool; said ribs including surfaces tapering inwardly from the outer edge of the spool towards the opening in the hub; said surfaces defining a frustoconical shape with the opening in the hub defining the top of the frustum; a clamping member pivotally attached to the outer end of the spindle which when in a clamped position exerts an axial force on the outer end of the spindle pulling the end portion into frictional engagement with the surfaces of the ribs thereby securing the spool in a fixed non-rotatable position relative to the spindle; and a pin fixedly secured to the clamping member which extends through an opening in the housing and is disposed between two stop members when the clamping member is in a clamped position thereby preventing the spool from rotating a distance greater than the distance between the pin and the furthest of the stop members between which it is disposed.

* * * * *